US005235252A

United States Patent [19]

Blake

[11] Patent Number: 5,235,252

[45] Date of Patent: Aug. 10, 1993

[54] FIBER-OPTIC ANTI-CYCLING DEVICE FOR STREET LAMPS

[76] Inventor: Frederick H. Blake, 3103 Red Cedar La., Mill Creek, Wash. 98012

[21] Appl. No.: 815,388

[22] Filed: Dec. 31, 1991

[51] Int. Cl.[5] ..... H05B 37/00

[52] U.S. Cl. ..... 315/151; 315/119; 315/159; 250/239

[58] Field of Search ..... 315/119, 151, 159, 127, 315/289, 290, 360, DIG. 2; 250/239

[56] References Cited

U.S. PATENT DOCUMENTS

| | | | |
|---|---|---|---|
| 3,621,269 | 11/1971 | Misencik | 250/239 X |
| 4,207,464 | 6/1980 | Fukuyama et al. | 250/239 |
| 4,207,500 | 6/1980 | Duve et al. | 315/119 |
| 4,467,246 | 8/1984 | Tanaka et al. | 315/151 X |
| 4,473,779 | 9/1984 | Lindner et al. | 315/119 |
| 4,731,551 | 3/1988 | Gibbs et al. | 315/159 X |
| 4,763,044 | 8/1988 | Nuckolls et al. | 315/176 |
| 4,810,936 | 3/1989 | Nuckolls et al. | 315/119 |
| 4,834,490 | 5/1989 | Falkenstein et al. | 250/239 X |
| 4,853,599 | 8/1989 | Singarayer | 315/119 |
| 4,874,989 | 10/1989 | Hilssen | 315/151 |
| 4,881,012 | 11/1989 | Almering | 315/209 R |
| 4,949,018 | 8/1990 | Siglock | 315/225 |
| 4,982,139 | 1/1991 | Amir et al. | 315/151 |
| 5,019,751 | 5/1991 | Flory, IV et al. | 315/290 |
| 5,070,279 | 12/1991 | Garbowicz et al. | 315/289 |
| 5,103,137 | 4/1992 | Blake et al. | 315/119 |

*Primary Examiner*—Eugene R. LaRoche
*Assistant Examiner*—Do H. Yoo
*Attorney, Agent, or Firm*—Bruce A. Kaser

[57] ABSTRACT

An anti-cycling device for high pressure sodium lamps detects an abnormal cycling condition by using a fiber-optic cable that extends between an anti-cycling controller board and the lamp itself. An outer end of the cable is arranged so that light emitted by the lamp will be transmitted to the controller board. A photocell mounted on the controller board, at the other end of the cable, transmits a variable magnitude electrical signal to the circuitry on the controller board. The signal varies in accordance with light being transmitted or not transmitted through the cable, as the case may be, corresponding to a cycling condition. In this manner, the controller board is able to detect a cycling condition, and thereby cause the power supply to the lamp to be cut off.

17 Claims, 7 Drawing Sheets

FIBER-OPTIC ANTI-CYCLING DEVICE FOR STREET LAMPS

DESCRIPTION

1. Technical Field

The invention disclosed here generally relates to electrical controls, and is specifically directed to high-pressure sodium lamps or luminares that are used in street lights and in high bay lighting of interior spaces. More particularly, the invention relates to controls that are operable to detect and shut off the power to such lamps in the event they abnormally cycle as a result of sodium depletion or other causes.

2. Background Art

High-pressure sodium lamps are well-known in the lighting field, and are currently in wide use by many public utilities for street lighting purposes. Although such lamps have a long life span, they eventually fail after an extended period of use because of sodium depletion. As the skilled person would know, the sodium inside the sealed glass bulb of this type of lamp becomes depleted to a point where lamp voltages can no longer maintain a continuous arc within the bulb. Furthermore, over a period of time, plating materials on lamp elements eventually cause a darkening on the inside of the bulb glass, which has a contributing effect to any given lamp's ability to maintain an arc as a result of sodium depletion. These factors typically create an abnormal cycling condition where the lamp continually flashes or attempts to start.

If abnormal cycling is allowed to continue for a long time, it eventually damages the lamp's starter/ballast unit, typically by burning out the ballast. When this happens, not only must the depleted lamp bulb be replaced, but the starter/ballast unit must be replaced as well. Having to replace the latter unit is expensive and creates higher overall costs of repair.

Further, in many modern light fixtures that fall within the high pressure sodium lamp category, electrical current continues to be used from the power lines even when the lamp is not illuminated or is otherwise completely burned out. Even worse, some fixtures have ballasts that draw higher levels of current when the lamp is burned out than it would otherwise draw when the lamp is burning properly. In either case, the end result is an unnecessary waste of power, making it important to detect and stop an abnormal cycling condition as soon as possible.

The inventor named here is also named as a co-inventor in U.S. patent application Ser. No. 07/503,394, which was filed on Apr. 2, 1990. As of the filing date of the present application, the '394 application has been allowed by the U.S. Patent Office and will soon be published.

As was discussed in the '394 application, few inventors or companies have successfully addressed the above-described cycling problem. The patent literature, for example, discloses that only a handful of inventions have been developed that directly relate to the problem, most of which issued within the last five years. In this regard, at the time the '394 application was filed, U.S. Pat. No. 4,207,500 (issued to Duve et al. on Jun. 10, 1980); U.S. Pat. No. 4,473,779 (issued to Lindner et al. on Sep. 25, 1984); U.S. Pat. No. 4,810,936 (issued to Nuckolls et al. on Mar. 7, 1989); and U.S. Pat. No. 4,853,599 (issued to Singarayer on Aug. 1, 1989) fairly represented the state of the art relative to anti-cycling detection and control. Since that time, U.S. Pat. No. 4,881,012 (issued to Almering on Nov. 14, 1989); U.S. Pat. No. 4,949,018 (issued to Siglock on Aug. 14, 1990) and U.S. Pat. No. 5,019,751 (issued to Flory and Nuckolls on May 28, 1991) have also issued, and thus represent more recent attempts at solving the same problem.

The fact that most of the relevant patents in this field of technology have issued only recently illustrates how the lighting industry is now beginning to recognize the cycling problem, and the potential commercial returns that will be realized by the first inventor or company to develop a cost-effective, anti-cycling device. As of yet, it is not believed that anyone has successfully met this need.

In order to be successful, an anti-cycling device must have the following characteristics: First, its cost to the end user, i.e. the lighting companies, must be sufficiently low in comparison to the replacement costs of starter/ballasts and lamp bulbs. Second, the installation time and labor for retrofitting existing lamps must be minimal. Lastly, the device must operate properly, regardless of the lamp or starter/ballast type.

During the course of attempting to implement the invention disclosed in the '394 application referenced above, it was discovered that the subject invention had drawbacks relating to all three of the above characteristics. Although it is believed that it does provide anti-cycling control circuitry that is extremely simple with respect to implementing the deactivation of a power supply to an abnormally cycling lamp, the mode by which cycling was detected could not be universally applied to all types of high-pressure sodium lamps. Further, it was designed to be installed as a separate unit inside the housing of a conventional street light. This entailed an unacceptable burden on the end-user, because of the labor and time involved in physically mounting the unit inside the housing, and making the necessary electrical connections to the high-voltage power lines. It is believed that many or most of the devices disclosed in the other patents referenced above have many of the same drawbacks.

As will become apparent, the invention disclosed here represents an improvement over and above the '394 invention, and the various other inventions referenced above. With the exception of the invention disclosed in U.S. Pat. No. 5,019,751, it is believed that prior attempts at solving the anti-cycling problem have always involved detecting a cycling condition by sensing changes in line current or voltage levels. The present invention represents a complete departure from these techniques. As will become apparent, the present invention provides an anti-cycling device that is light-triggered. That is to say, the light from the lamp itself, as opposed to the current and voltages which cause the lamp to burn, is what triggers the present invention. How the present invention works, including its advantages, will now be discussed and described below.

SUMMARY OF THE INVENTION

The present invention is an anti-cycling device having an anti-cycling controller or anti-cycling control circuitry that is operable to cut off the power supply to a high pressure sodium lamp once an abnormal cycling condition has been detected. In accordance with the invention, cycling is detected by a light sensor that inputs a light-triggered signal to the controller as the lamp goes on or off, corresponding to the lit and unlit conditions which normally occur when the lamp cycles. The light sensor is adapted to directly receive light that is emitted from the lamp. In other words, the sensor generates the cycling or triggering signal by sensing light that is emitted from the lamp itself, instead of sensing changes in current and voltage that also occur during lamp cycling.

In preferred form, the light sensor comprises a fiber-optic cable that extends between the anti-cycling controller and the lamp. An outer end of the cable is positioned so that at least some of the light emitted by the lamp is transmitted along the cable to the controller. A photocell at the other end of the able generates an electrical signal that varies as light is transmitted or not transmitted through the cable, as the case may be, corresponding to lamp cycling. Such signal is input into the anti-cycling circuitry making up the controller, and enables the controller to thereby detect and determine whether or not the lamp is cycling abnormally. When an abnormal cycling condition is detected, the controller causes the lamp's power supply to be cut off.

The light sensor summarized above could be used in conjunction with different kinds of anti-cycling or power supply controllers. In accordance with the invention disclosed here, however, the anti-cycling controller is in the form of anti-cycling control circuitry that is mounted to or carried by an anti-cycling board. The anti-cycling board is mounted to a power supply board which, in turn, carries power control circuitry for normally activating and/or de-activating the power supply to the lamp. In the event a cycling condition is detected via the light-triggered signal provided by the light sensor, the anti-cycling controller signals the power supply circuitry, on the power supply board, to cut off power to the lamp.

Both the anti-cycling and power supply boards are received within a housing that is mountable to the top of a conventional street light fixture. The fiber-optic cable which makes up a portion of the light sensor described above, extends from such housing and is connected to the fixture's reflector by a low heat-conducting fitting, which should also be opaque to infrared light. Such fitting defines a light-transmitting passageway through the reflector and into the outer end of the fiber-optic cable, so that light from the lamp is transmitted to the photocell at the other end of the cable.

The various advantages of the invention will become apparent upon review of the following description which should be read in conjunction with the drawings.

BRIEF DESCRIPTION OF THE DRAWINGS

In the drawings, like reference numerals and letters refer to like parts throughout the various views, unless indicated otherwise, and wherein.

BEST MODE FOR CARRYING OUT THE INVENTION

Figure 1:
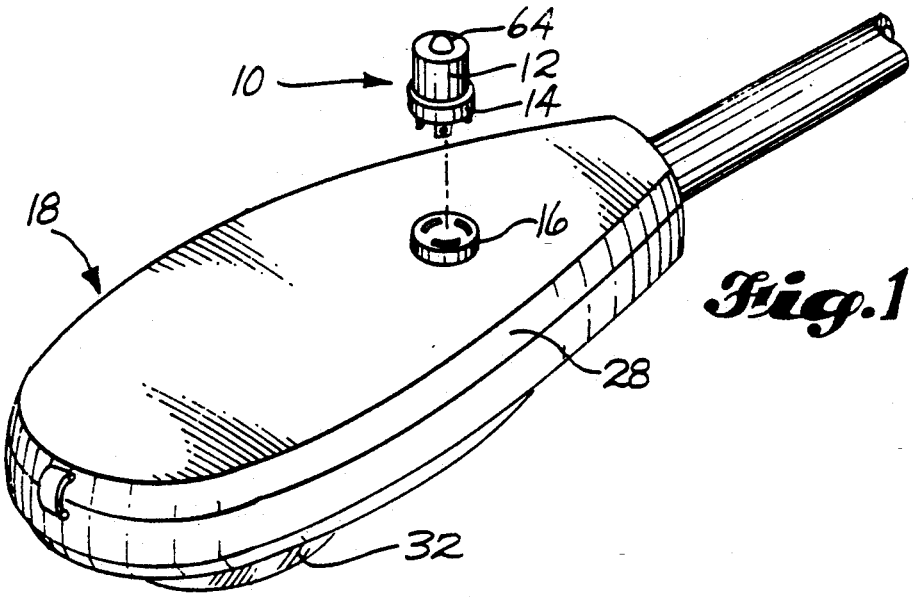
FIG. 1 is a pictorial view of a conventional street light fixture, looking down on top of the housing for such fixture, and shows how a power supply/anti-cycling unit in accordance with the invention is mounted to an existing electrical socket fitting on top of the housing.

Referring now to the drawings, and first to FIG. 1, shown generally at 10 is a power supply/anti-cycling control unit in accordance with a preferred embodiment of the invention. Referring now to FIG. 3, the unit 10 includes a hollow housing 12 that is generally cylindrical in shape. A base portion of the housing, indicated at 4, is shaped for mounting the housing directly to a pre-existing electrical socket fitting 16, the latter being conventional in nature and is typically found on top of most or all modern street light fixtures 18 (see FIGS. 1 and 2).

Three electrical prongs 20*a*, 20*b*, 20*c* extend downwardly from the base portion 14 of the unit 10, and are inserted into corresponding slots 22*a*, 22*b*, 22*c* in the socket fitting 16. After insertion, the unit 10 is turned to lock it in place relative to the lamp or light fixture 18. Such connection is conventional, and would be familiar to the skilled person. The electrical prongs 20*a*, 20*b*, 20*c* electrically connect the unit 10 to the power lines which supply high voltage and current to the light fixture 18, including the ballast/starter 24 (see FIG. 2) and high-pressure sodium lamp 26 within the fixture's housing 28.

Figure 2:
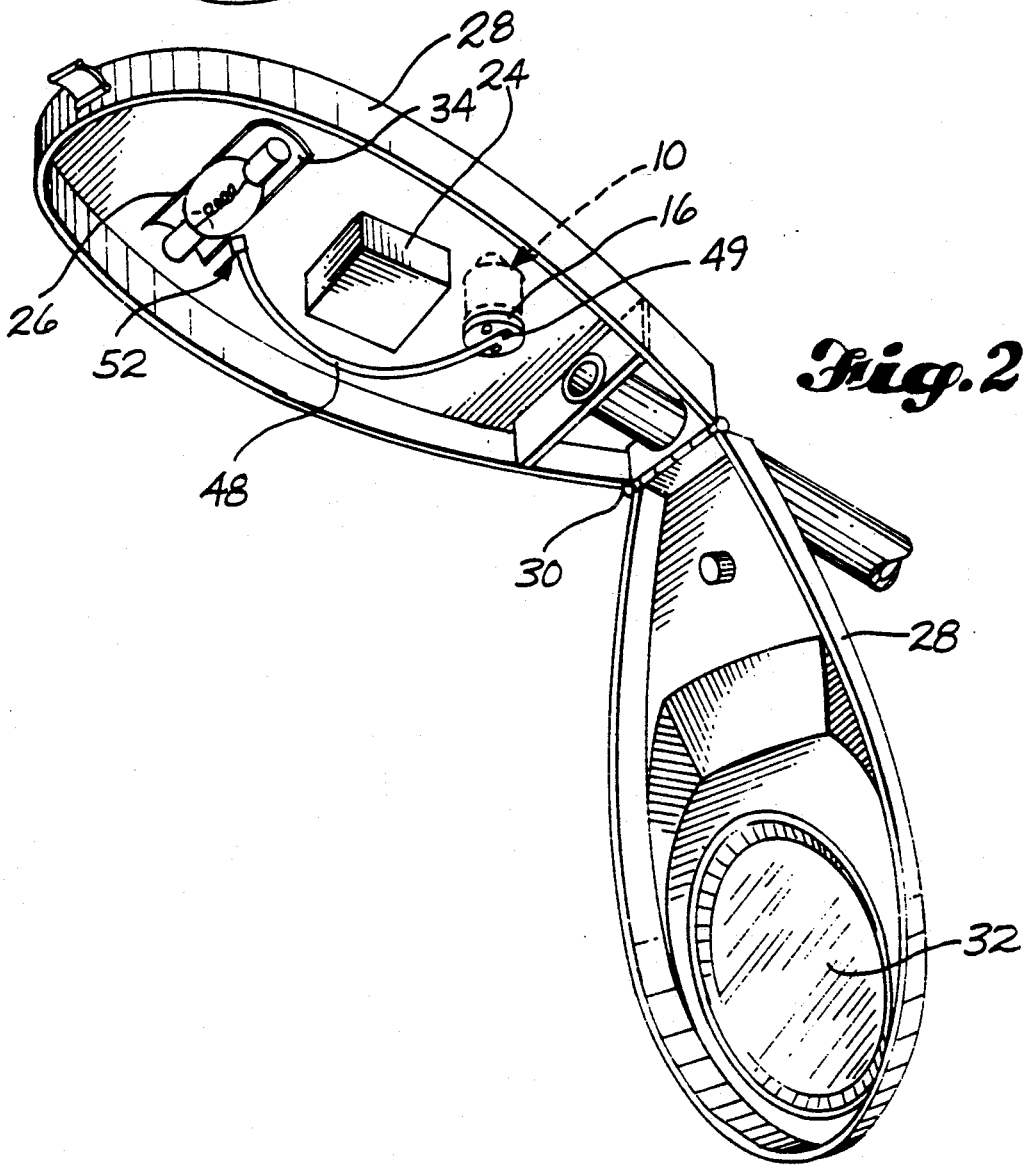
FIG. 2 is a pictorial view of the fixture shown in FIG. 1, but looking from a lower side thereof, and shows the lower half of the fixture housing in an open condition for accessing various components within the housing.
Figure 3:
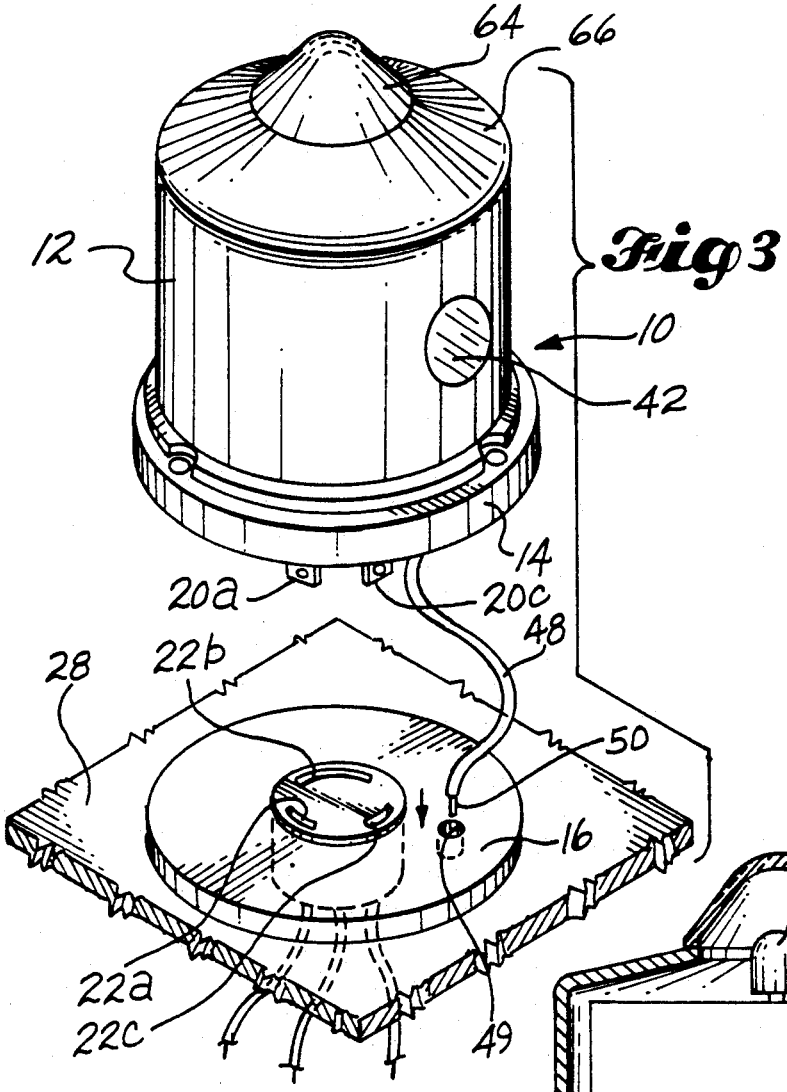
FIG. 3 is an enlarged pictorial view of the anti-cycling/power control unit shown in FIG. 1.
Figure 5:
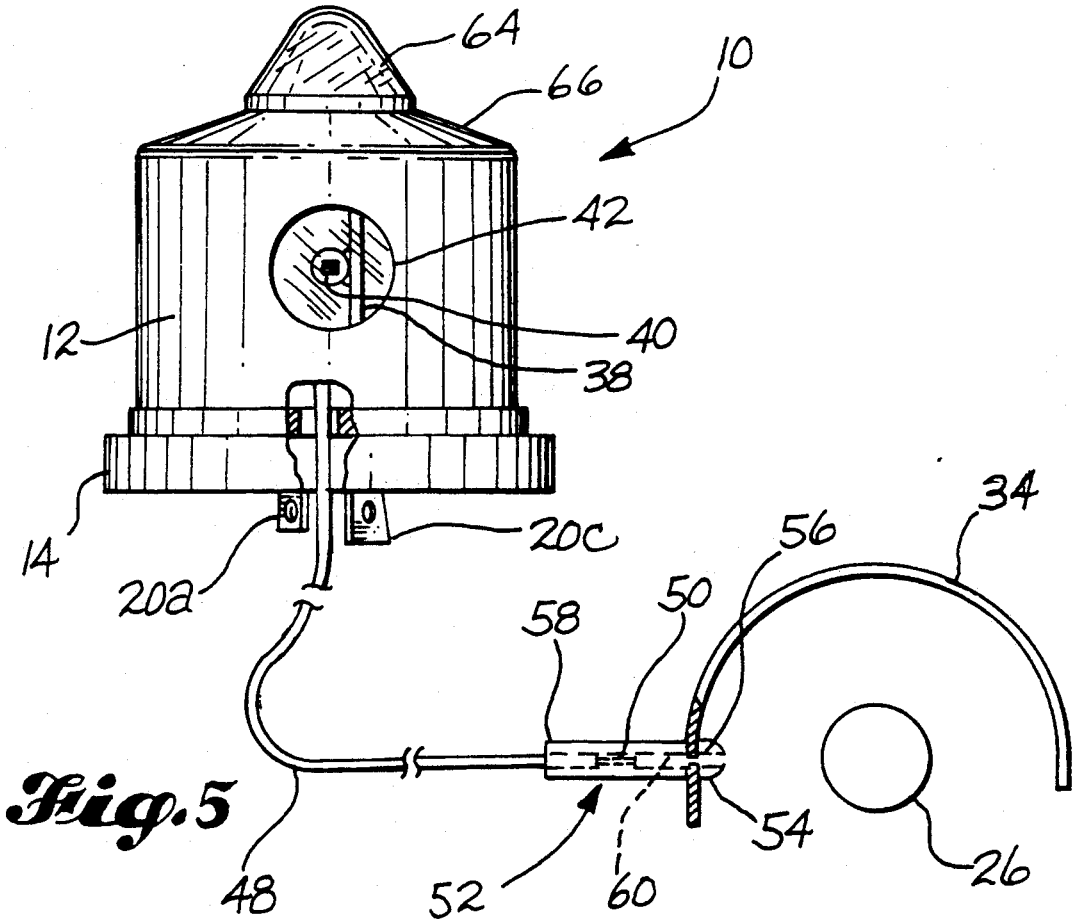
FIG. 5 is a side view of the unit shown in FIGS. 3 and 4.
Figure 6:
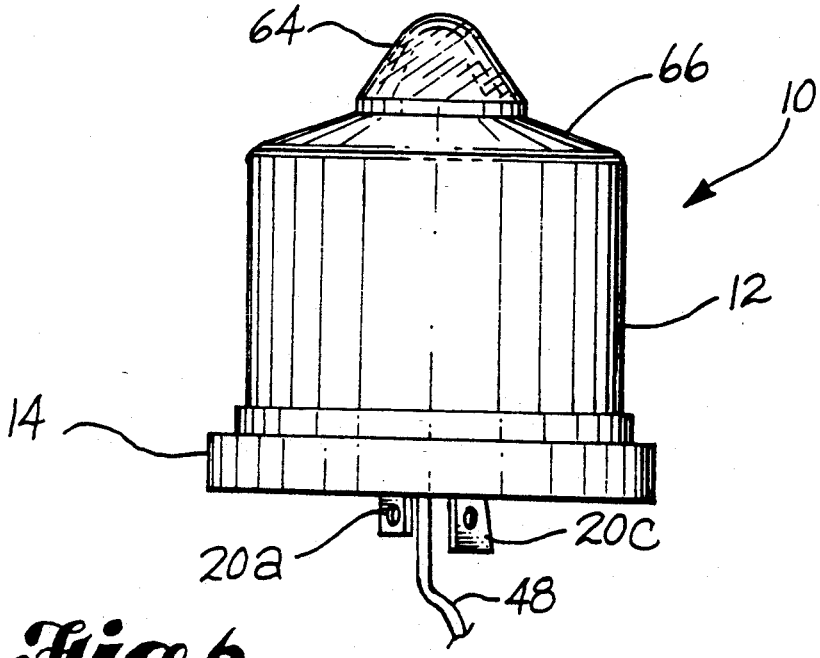
FIG. 6 is another side view of the unit shown in FIGS. 3-5.
Figure 7:
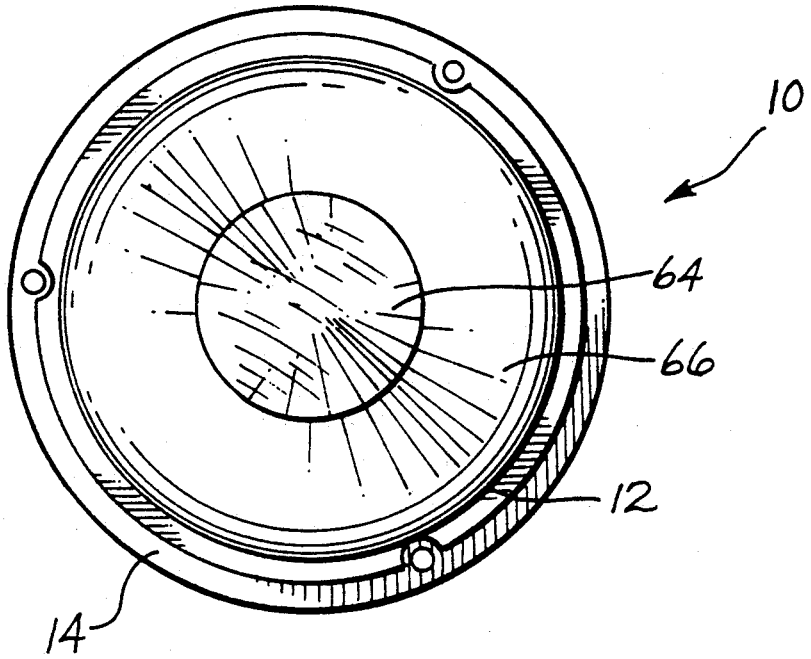
FIG. 7 is a top plan view of the unit shown in FIGS. 3-6.
Figure 8:
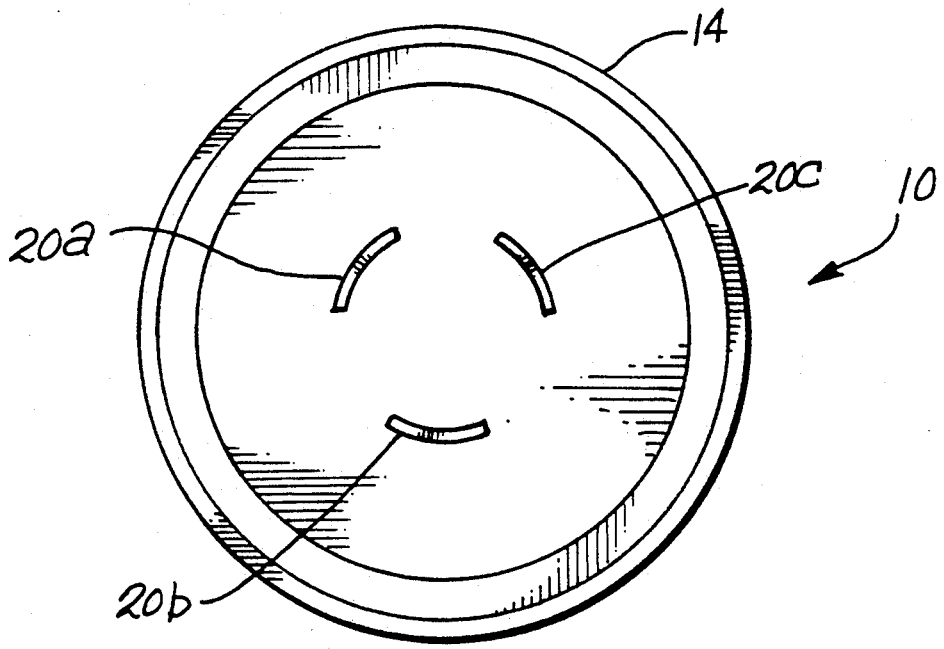
FIG. 8 is a bottom plan view of the unit shown in FIGS. 3-7.

A person skilled in the art would be familiar with the light fixture 18 as it is depicted in FIGS. 1 and 2 and described above. The skilled person would also know that the fixture housing 28 is hinged, as indicated at 30, and may be opened to reveal the various elements or components 24, 26 located inside. As mentioned above, the electrical socket fitting 16 is located on an upper or top side of the housing 28. In the lower side, a conventional lens 32 is positioned adjacent the lamp 26. The lamp 26 is also surrounded by a reflector 34, a portion of which is schematically shown in FIG. 5. Light from the lamp 26 and reflector 34 is transmitted downwardly through lens 32 to an area that underlies the lamp fixture 18.

Figure 4:
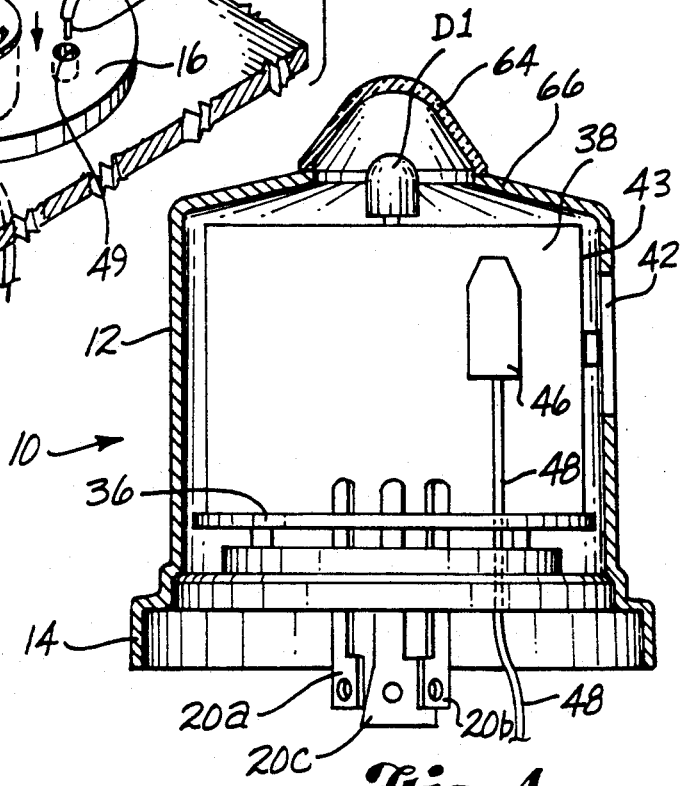
FIG. 4 is a side cross-sectional view of the unit shown in FIG. 3.
Figure 9:
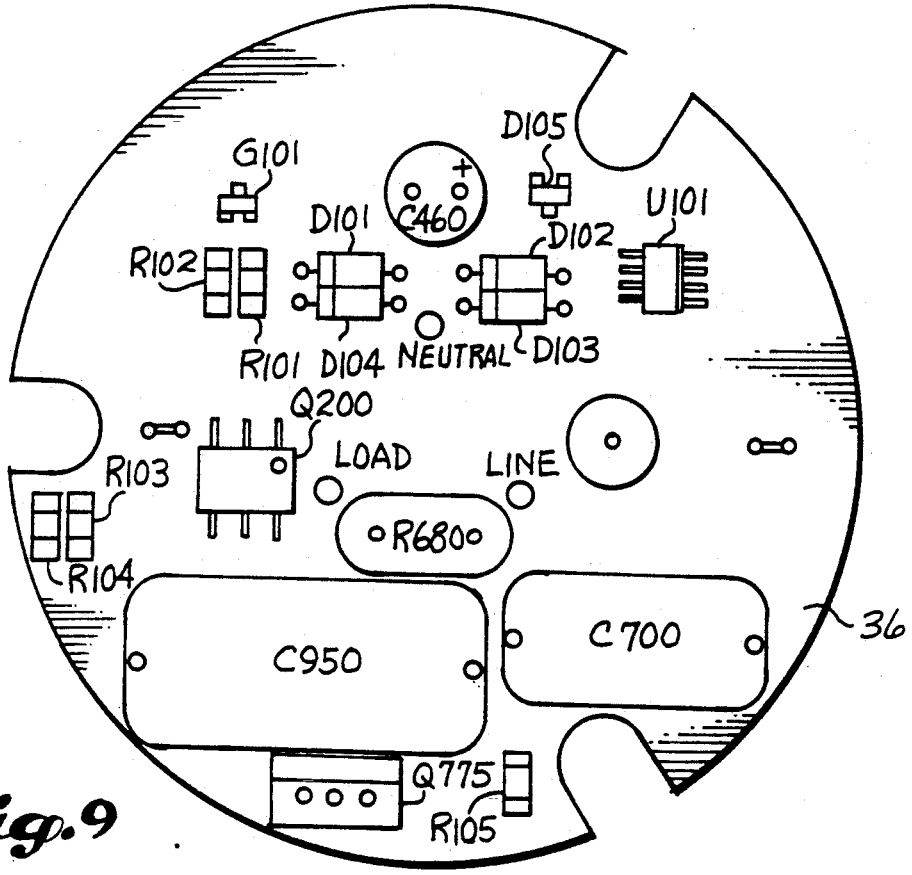
FIG. 9 is an assembly drawing of the power control board that is received within the unit housing shown in FIGS. 3-8.
Figure 10:
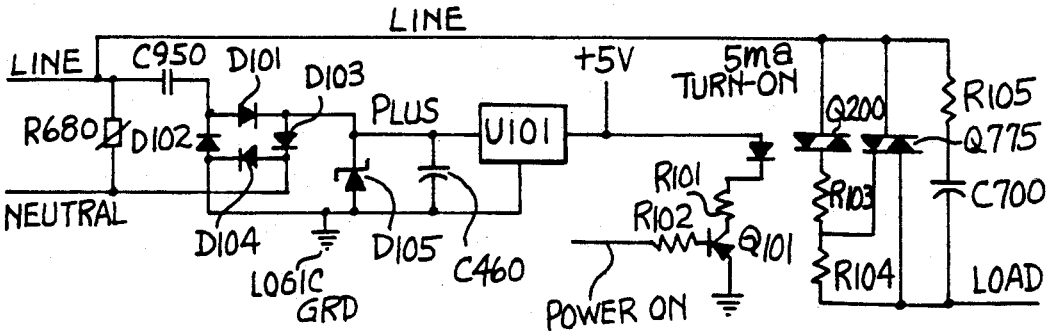
FIG. 10 is an electrical schematic of the power control circuitry which is mounted to or carried by the power supply board shown in FIG. 9.

Referring now to FIG. 4, the power supply/anti-cycling control unit 10 has a power supply board 36, and an anti-cycling control board 38, both of which are received within the unit's housing 12. The power supply board 36 is better seen in FIG. 9. Directing attention there, it is generally circular in shape, and carries the electrical elements or parts which make up the power control circuitry shown in FIG. 10. The above-described connection pins 20*a*, 20*b*, 20*c* extend downwardly from the power control board 36, and connect into the lamp power line as schematically shown in FIG. 10. The circuitry of FIG. 10 either enables power to be supplied to the ballast/starter 24, or cuts it off, depending on an electrical signal received from a photocell 40, the latter also being identified by part number "PC1" in FIG. 11. Such photocell 40 is positioned adjacent a first light-transmitting window 42 in a side of the unit housing 12.

Referring now to FIG. 4, the anti-cycling control board 38 is vertically upstanding with respect to the power supply board 36. It is mounted directly to the power supply board 36 by suitable mechanical connections that are electrically non-conductive. The photocell 40 described above is mounted adjacent a side edge 43 of the anti-cycling board 38, in a position so that it is adjacent to and will view ambient light directly through side window 42 (see FIG. 5).

Figure 12:
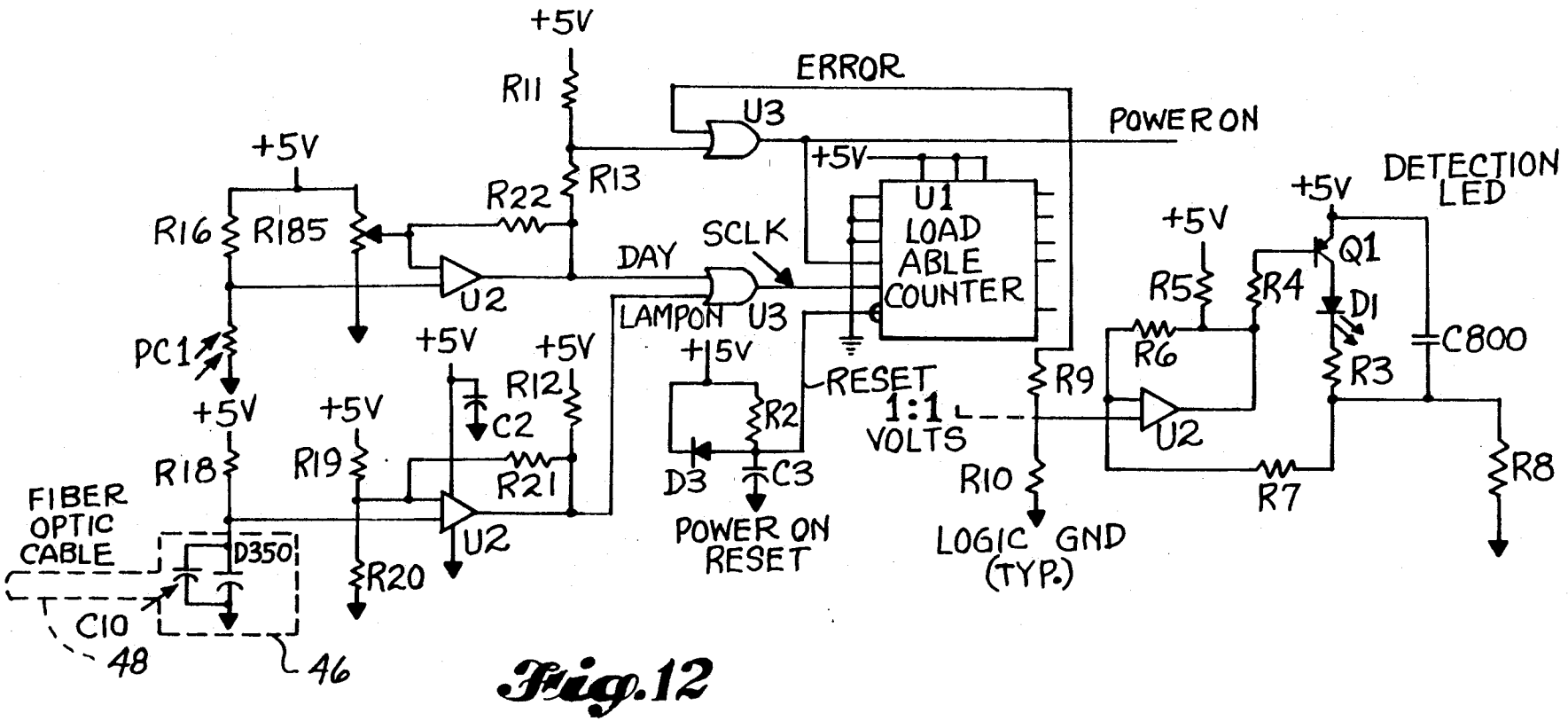
FIG. 12 is an electrical schematic of the anti-cycling control circuitry which is mounted to the board shown in FIG. 11.

The anti-cycling control board 38 carries the elements or parts making up the control circuitry shown in FIG. 12. The "POWERON" output in FIG. 12 corresponds to the same input in FIG. 10 and, as the skilled person would recognize, shows how the photocell 40 signals the power control circuitry to either supply or cut off power, depending on whether the ambient light corresponds to night or daytime conditions. A fiber-optic cable input, which is indicated generally by arrow 44 in FIG. 12, provides a triggering input to the anti-cycling circuitry shown in FIG. 12, and enables the anti-cycling circuitry to detect lamp cycling, and to cut off power to the lamp in the event a cycling condition is detected. This will now be described in further detail below.

Figure 11:
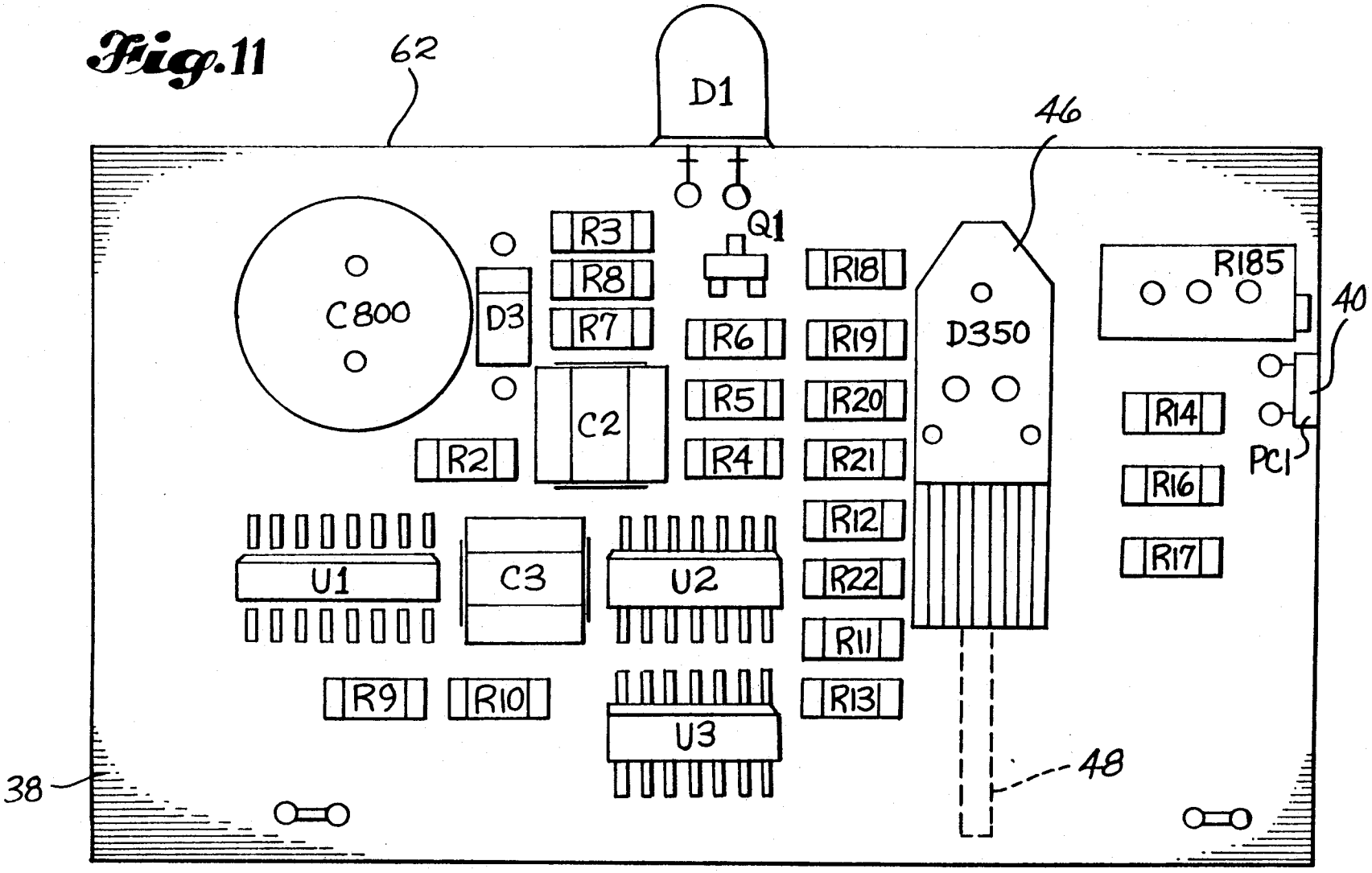
FIG. 11 is an assembly drawing of an anti-cycling control board which is also received in the unit housing shown in FIGS. 3-8.

A second photocell unit 46 is mounted directly to the anti-cycling board 38, in the location shown in FIG. 11. Such unit is also indicated by part number "D350". One end of a conventional fiber-optic cable 48 is connected to such unit, and extends downwardly through the power supply board 36, and out through the base portion of the unit housing 12 in the manner shown in FIG. 5.

When the unit 10 is installed or mounted on top of the light fixture 18, as shown in FIG. 1, the fiber-optic cable 48 extends all the way from the unit 10 to the reflector 34 inside the light fixture 18. The position of the cable 48 within the fixture housing 28 is best seen in FIG. 2. As the unit 10 is mounted, an outer or light-receiving end 50 of the cable 48 is passed through a small opening 49 in electrical socket fitting 16. It is believed that most fixtures like fixture 18 shown in FIGS. 1 and 2, which are presently in use, already have an opening like opening 49, which makes it easy to extend the cable 48 down into the fixture housing as the unit 10 is installed. If not, it would be a relatively simple matter to create a suitable opening through the socket fitting 16.

The outer end 50 of the cable is mounted to the reflector 34 via another fitting 52. Such fitting 52 has a forward portion 54 that is snap-fit into an opening 56 made through the wall of the reflector 34. When installing the unit 10 for the first time in a retrofit situation, the maintenance person would normally create the reflector opening 56 for accommodating the snap-fit connection just described. The fiber-optic cable's outer end 50 is crimped into an outer portion 58 of the fitting 52, and is thereby held in position a certain distance that is spaced outwardly from the reflector 34.

As the skilled person would know, the reflector 34 heats up substantially after the lamp 26 has been running for a certain period of time. In order to protect the fiber-optic cable 48 from being exposed to unacceptable levels of heat, it is necessary to space it from the reflector or otherwise insulate it in some manner. Spacing the cable's end 50 from the reflector via fitting 52 accomplishes this purpose. Further, the fitting 52 should preferably be made of a substantially low heat-conducting material such as, for example, a polycarbonate material. In addition to being low heat-conducting, the fitting 52 should also be opaque to the transmission of infrared light.

The fitting 52 defines a light-transmitting passageway 60 through the reflector 34 and into the cable's outer end 50. When the lamp 26 is burning, some of its light will therefore be transmitted through fiber-optic cable 48 to the photocell 46 mounted on the anti-cycling board 38.

When the lamp 26 cycles, the corresponding "ON" and "OFF" light signal that is transmitted by the fiber-optic cable 48 causes the photocell 46 to alter its output, and thereby transmit an electrical signal that corresponds to cycling. Referring again to FIG. 12, such signal triggers a loadable counter U1 every time light in the fiber-optic cable goes from "ON" to "OFF". Upon receipt of the third triggering signal, the counter U1 outputs an error signal to a norgate U3, which in turn signals the power supply circuitry shown in FIG. 10 to cut-off further power to the fixture 18.

At the same time, the counter U1 also activates LED D1 which is mounted to an upper edge 62 of the anti-cycling board 38. LED D1 is positioned adjacent a second window 64 in the top portion 66 of the unit housing 12. The LED D1 serves as a warning light that remains on during the following day, and would be visible through window 64 to a maintenance person, thereby informing him or her that the fixture 18 is cycling or is otherwise malfunctioning.

Table I below sets forth a parts list for the various electrical components mounted to the anti-cycling board 38. Such components should be viewed as the anti-cycling controller portion of the power supply/anti-cycling unit 10. The part numbers in Table I correspond to like part numbers in FIG. 12. FIG. 12 is a schematic of the anti-cycling control circuitry which is mounted to or carried by the anti-cycling board 38. An assembly drawing of such board is shown in FIG. 11, which also depicts the same part numbers that are displayed in FIG. 12 and in Table I.

TABLE I

ANTI-CYCLING LOGIC BOARD BILL OF MATERIALS

| Quantity | Reference | Part | DESCR | MFG | Part Number |
|---|---|---|---|---|---|
| 3 | C2, C3, C10 | .33 uF | CAP SMT | KEMET | C1825C334M5RAC |
| 1 | C800 | 1000 uF | CAP T/H | MEPCO | 3476HF102M010JMBS |
| 1 | R3 | 68 | RES SMT | DALE | RC1206XXXJ |
| 1 | R4 | 1K | RES SMT | DALE | RC1206XXXJ |
| 2 | R8, R13 | 2K | RES SMT | DALE | RC1206XXXJ |
| 1 | R18 | 5K | RES SMT | DALE | RC1206XXXJ |

TABLE I-continued

| Quantity | Reference | Part | ANTI-CYCLING LOGIC BOARD BILL OF MATERIALS DESCR | MFG | Part Number |
|---|---|---|---|---|---|
| 2 | R5, R10 | 10K | RES SMT | DALE | RC1206XXXJ |
| 2 | R11, R12 | 20K | RES SMT | DALE | RC1206XXXJ |
| 1 | R7 | 22K | RES SMT | DALE | RC1206XXXJ |
| 2 | R19, R20 | 33K | RES SMT | DALE | RC1206XXXJ |
| 1 | R9 | 36K | RES SMT | DALE | RC1206XXXJ |
| 3 | R2, R6, R16 | 100K | RES SMT | DALE | RC1206XXXJ |
| 2 | R21, R22 | 200K | RES SMT | DALE | RC1206XXXJ |
| 1 | R185 | 100K POT | POT 100K | BOURNES | 3296X-1-104 |
| 1 | Q1 | 2N3906 | TRANSTR SMT | MOTOROL | MMBT3906LT1 |
| 1 | D3 | 1N4148 | DIODE T/H | MOTOROLA | |
| 1 | D1 | LED | LED | STANLEY | H2000L |
| 1 | D350 | MFOD71 | LIGHT SENSOR T/H | | MFOD71 |
| 1 | PC1 | PC | PHOTOCELL T018 | SILONEX | NSL-4172 |
| 1 | U2 | LM339 | QUAD CMP SMT | MOTOROLA | LM339D |
| 1 | U3 | 4001 | QUAD NOR SMT | MOTOROLA | MC4001BD |
| 1 | U1 | 14161 | COUNTER SMT | MOTOROLA | MC1416BD |

Likewise, Table II below sets forth a parts list for the various electrical components mounted to the power supply board 36. Such board 36 should be viewed as the power controller portion of the power supply/anti-cycling unit 10. The part numbers in Table II correspond to the part numbers shown in FIG. 10. FIG. 10 depicts the power supply control circuitry which is carried by the power supply board 36. FIG. 9 is an assembly drawing of such board 36, and also displays the same part numbers that are displayed in FIG. 10 and in Table II.

TABLE II

| Quantity | Reference | Part | ANTI-CYCLING POWER BOARD BILL OF MATERIALS DESCR | MFG | Part Number |
|---|---|---|---|---|---|
| 1 | C700 | .022 uF | CAP T/H | PANASONIC | ECQ-E10223KZ |
| 1 | C950 | 1 uF | CAP T/H 1000 V | PANASONIC | ECQ-E10104KZ |
| 1 | C460 | 220 uF | CAP T/H | MEPCO | 3476FC221MO10JMBS |
| 1 | R101 | 470 | RES SMT | DALE | RC1206XXXJ |
| 2 | R103, R104 | 1K | RES SMT | DALE | RC1206XXXJ |
| 1 | R102 | 4.7K | RES SMT | DALE | RC1206XXXJ |
| 1 | R680 | MOV | VSTR T/H, 400 V | PANASONIC | ERZ C10DK681U |
| 1 | Q101 | 2N2222 | TRANSTR SMT | MOTOROLA | MMBT2222LT1 |
| 1 | Q200 | MOC3083 | OPTOISLTR SMT | MOTOROLA | MOC3083 |
| 1 | Q775 | MAC22810 | TRIAC T/H | MOTOROLA | MAC22810 |
| 4 | D101, D102, D103, D104 | 1N4004 | DIODE T/H | MOTOROLA | |
| 1 | D105 | 1N4101 | DIODE SMT | MOTOROLA | MMBZ5237B |
| 1 | U101 | LM7805 | VLT REG SMT | MOTOROLA | MC78L05 |
| 1 | R105 | 1 WATT | | | |

The skilled person, having the benefit of the information listed on Tables I and II, along with the electrical schematics shown in FIGS. 10 and 12, could easily ascertain how the invention works, and could easily build it in the form depicted in FIGS. 1-5, or otherwise adapt the circuitry of FIGS. 10 and 12 to a different form of power supply/anti-cycling unit.

The fitting 52 Which is connected to the reflector 34; the fiber-optic cable 48 which extends from the fitting 52 to the photocell 46 on the anti-cycling control board; and the photocell 46 itself, together define a light sensor that is operable to create a light-triggered signal that is input to the anti-cycling controller or, in other words, the anti-cycling control circuitry shown in FIG. 12. Unlike other anti-cycling devices, the controller or control circuitry shown in FIG. 12 is therefore not triggered by monitoring voltage or current that is supplied to either the ballast/starter unit 24 or the lamp 26 of the light fixture 18. Instead, it is the light which is emitted directly by the lamp 26 itself, transmitted via fiber-optic cable 48, which provides the triggering signal. Detecting anti-cycling in this way, eliminates any need for more complicated voltage and/or current sensing methods.

The above description sets forth the best mode for carrying out the invention claimed here as it is presently known. It is conceivable that there will be future improvements and/or modifications to the power supply/anti-cycling control unit described above. For this reason, the preceding description should not be viewed as limiting the scope of what is intended to be the invention. Instead, the scope of the invention is to be limited only by the subjoined claims which follow, the interpretation of which is to be made in accordance with the established doctrines of claim interpretation.

What is claimed is:

1. For use in connection with a high-voltage, high-pressure sodium lamp, said lamp being connected to a power supply that is operable to cause said lamp to emit light, an anti-cycling device for cutting off power to said lamp in the event said lamp cycles on and off in an abnormal manner, said anti-cycling device comprising:

an anti-cycling control circuit portion, said control circuit portion being operable to selectively cut off the power supply to said lamp; and a light sensor adapted to view light that is emitted by said lamp, said light sensor being operably connected to said anti-cycling control circuit portion, and operable to generate a light-triggered cycling signal that is received by said anti-cycling control circuit portion, for enabling said control circuit portion to detect an abnormal cycling condition of said lamp, and to cut off the power supply to said lamp in response to said abnormal cycling condition.

2. The anti-cycling device of claim 1, wherein said light sensor comprises a fiber-optic cable that is operable to transmit at least some of the lamplight emitted by said lamp, said cable extending from said control circuit portion to a position adjacent said lamp such that an outer end of said cable is positioned to receive said emitted lamplight, said light sensor further including a photocell positioned adjacent the other end of said cable, for receiving lamplight transmitted by said cable, said photocell generating an electrical signal that varies as light is transmitted or not transmitted through said cable, corresponding to lamp cycling between lit and unlit conditions, said electrical signal producing said triggering signal that is received by said anti-cycling control circuit portion, for enabling said control circuit portion to detect said abnormal cycling condition.

3. The anti-cycling device of claim 2, wherein a reflector substantially surrounds said lamp and defines a light-reflecting wall, and said light sensor further includes a fitting that is connected to said lamp reflector, for mounting said outer end of said fiber-optic cable to said reflector, said fitting defining a light passageway through said light-reflecting wall for guiding emitted lamplight into said outer end of said cable.

4. The anti-cycling device of claim 3, wherein a portion of said fitting is received within an opening that extends through said light-reflecting wall, and said outer cable end is connected to another portion of said fitting, in a manner so that said outer cable end is outwardly spaced from contact with said reflector.

5. The anti-cycling device of claim 3, wherein said fitting is made of a low heat-conducting, high-temperature material.

6. The anti-cycling device of claim 3, wherein said fitting is made from a material that is substantially opaque to infrared light.

7. The anti-cycling device of claim 2, including means for insulating said outer end of said cable from heat generated by said lamp.

8. The anti-cycling device of claim 2, wherein said outer end of said cable is substantially opaque to infrared radiation.

9. A power supply/anti-cycling control unit for a street light, said street light having a high-pressure sodium lamp received within a street light housing, said lamp being connected to a power supply that is operable to supply starting and operating current and voltages to said lamp, said street light housing further having a lens in a lower side thereof through which light emitted by said lamp is transmitted onto a ground area that is normally below said housing, and a reflector wall within said housing that substantially surrounds said lamp, for directing said emitted light downwardly through said lens, and an electrical socket fitting positioned in an upper side of said housing, said power supply/anti-cycling unit comprising:

a unit housing having a cylindrically-shaped base portion that is connectable to said electrical socket fitting, said unit housing having first and second light-transmitting windows spaced apart from each other;

an ambient light photocell received within said unit housing adjacent the first window, for receiving ambient light from outside said unit housing;

a warning light positioned adjacent the second window, for emitting a visible light signal to a maintenance person when said anti-cycling unit detects an abnormal cycling condition of said lamp;

a power supply board received within said unit housing, said power supply board carrying power control circuitry that is responsive to electrical signals from said ambient light photocell, for either activating or de-activating said power supply to said lamp in response to whether or not said photocell signal indicates night or day;

an anti-cycling board also received within said unit housing, said anti-cycling board carrying anti-cycling control circuitry that is operable to determine said abnormal lamp cycling condition, and to signal said power control circuitry to de-activate said power supply to said lamp and to illuminate said warning light in the event said abnormal lamp cycling condition is detected; and further including a light sensor adapted to receive light emitted from said lamp, said light sensor being operably connected to said anti-cycling control circuitry, said light sensor being operable to generate a light-triggered cycling signal that is received by said anti-cycling control circuitry, for enabling said anti-cycling control circuitry to determine said abnormal cycling condition.

10. The power supply/anti-cycling control unit of claim 7, wherein said power supply board is a circular board that is positioned horizontally within said unit housing adjacent said base portion thereof, and said anti-cycling board is mounted to said power supply board, and upstands vertically relative to said power supply board, and wherein said first window is positioned in a sidewall of said unit housing adjacent an edge of said anti-cycling board, with said photocell being mounted adjacent said edge and adjacent said first window, and wherein said second window is positioned in a top portion of said unit housing, such top portion being near an upper edge of said anti-cycling board, said warning light being mounted adjacent said upper edge and adjacent said second window, in a manner so that said warning light is visible through said second window.

11. The power supply/anti-cycling control unit of claim 7, wherein said light sensor comprises a fiber-optic cable that is operable to transmit at least some of said emitted lamplight, with said cable extending from said anti-cycling board to a position adjacent said lamp such that an outer end of said cable directly receives emitted lamplight, said light sensor including a lamplight photocell mounted to said anti-cycling board that is positioned adjacent the other end of said cable, for receiving lamplight transmitted by said cable, said lamplight photocell generating an electrical signal that varies as light is transmitted or is not transmitted through said cable, corresponding to lamp cycling between lit and unlit conditions, said electrical signal being input to said anti-cycling control circuitry and defining said light-triggered anti-cycling signal, for enabling said anti-cycling control circuitry to detect said abnormal cycling condition.

12. The power supply/anti-cycling control unit of claim 11, wherein said light sensor further includes a fitting that is connectable to said reflector wall within said street light housing, for mounting said outer end of said fiber-optic cable to said reflector wall, said fitting defining a light passageway through said reflector wall for guiding emitted lamplight into said outer end of said cable, a portion of said fitting being received within an opening that extends through said reflector wall, and said outer cable end being connected to another portion of said fitting, in a manner so that said outer end is outwardly spaced from contact with said reflector wall.

13. The power supply/anti-cycling control unit of claim 12, wherein said fitting is made of a low heat-conducting, high-temperature material.

14. The power supply/anti-cycling control unit of claim 12, wherein said fitting is made from a material that is substantially opaque to infrared light.

15. The anti-cycling device of claim 11, including means for insulating said outer end of said cable from heat generated by said lamp.

16. The anti-cycling device of claim 11, wherein said outer end of said cable is substantially opaque to infrared radiation.

17. A device for preventing a high-voltage lamp from abnormally cycling, the device comprising:

an anti-cycling control circuit portion operable to cut off the power supply of the lamp in response to receipt of a cycling malfunction signal; and a light sensor having a fiber-optic cable, one end of the cable being arranged relative to the lamp in a manner so that the cable receives and conveys at least some of the light radiation emitted by the lamp, the light sensor including a photocell arranged relative to the outer end of the cable in a manner so that the photocell receives at least some of the conveyed radiation, the photocell generating an electrical output that cycles in correspondence with abnormally cycling lamp radiation conveyed by the cable, and the output of the photocell being used to produce the cycling malfunction signal.

* * * * *